United States Patent [19]

Lods

[11] Patent Number: 4,938,480

[45] Date of Patent: Jul. 3, 1990

[54] COACH'S RP SPECIAL LACROSSE STICK STRING CONFIGURATION

[75] Inventor: Randy P. Lods, Sandy Spring, Md.

[73] Assignee: Coach's, Olney, Md.

[21] Appl. No.: 438,247

[22] Filed: Nov. 20, 1989

[51] Int. Cl.[5] ..... A63B 59/02

[52] U.S. Cl. ..... 273/326

[58] Field of Search ..... 273/326

[56] References Cited

U.S. PATENT DOCUMENTS

| | | | |
|---|---|---|---|
| 2,142,527 | 1/1939 | Pool | 273/326 |
| 3,507,495 | 4/1970 | Tucker et al. | 273/326 |
| 3,822,062 | 7/1974 | Tucker et al. | 273/326 |

*Primary Examiner*—William H. Grieb

*Attorney, Agent, or Firm*—Cushman, Darby & Cushman

[57] ABSTRACT

A string configuration for a lacrosse stick which combines the advantages of longitudinal thongs with the advantages of a mesh like webbing. The strung head thus includes at least first and second longitudinal thong elements and a mesh portion which extends at least between each of the longitudinal thong elements and a sidewall of the head. The longitudinal thongs are mounted to the mesh portion along the lengths thereof. A transverse lacing is further provided which reinforces the lacrosse stick webbing adjacent the upper end of the head. The upper end of the mesh is coupled to the frame by the longitudinal thong elements as well as a transverse thong element. The lower end of the mesh is coupled to the throat of the frame with the longitudinal thong elements so as to define the ball receiving pocket of the head.

20 Claims, 3 Drawing Sheets

COACH'S RP SPECIAL LACROSSE STICK STRING CONFIGURATION

BACKGROUND OF THE INVENTION

1. Field of the Invention

The present invention relates to lacrosse sticks and, in particular, to a string configuration for the head of a lacrosse stick.

2. Description of the Related Art

A number of string configurations for lacrosse sticks have been developed in an effort to increase the useful life of that portion of the lacrosse stick and enhance control of the ball.

For example, one commonly used lacrosse string configuration is known as the "Traditional". As shown, for example, in U.S. Pat. No. 3,507,495, that string configuration includes four longitudinal thong elements which extend between respective apertures defined in the head of the lacrosse stick and the base of the head adjacent the stop. A relatively open weave lacing extends transversely of the head to interconnect the longitudinal thongs and maintain the same in a predetermined spaced relation. The assembly thus forms a ball pocket for catching, carrying and throwing the ball. Transverse lacing is further provided adjacent the upper end of the head of the lacrosse stick to reinforce the string in this region. Indeed, it is that portion where the ball ordinarily makes first contact on catching and last contact on throwing and, hence, the strength and durability of that portion is of primary concern.

While the foregoing string configuration has gained wide acceptance in the field, the relatively limited resiliency of the longitudinal thongs and open weave lacing yields a string configuration that lacks a ball pocket which conformingly receives the ball to facilitate carrying while allowing easy release of the same. Thus ball handling with the "Traditional" stick can be disadvantageous. Furthermore, because the lacing interconnecting the longitudinal thongs is relatively open weave and formed merely by looping a single strand of string about the thongs and about itself, should a portion of the lacing become severed, the lacing will be affected over a large area and, in fact, the entire head may need to be restrung.

Another lacrosse stick string configuration known in the art is known as the "Mesh". As shown, for example, in U.S. Pat. No. 3,822,062, rather than the longitudinal thongs and open weave lacing of the "Traditional" lacrosse stick, the "Mesh" employs a mesh knitted as a continuous strip of woven material. The mesh is peripherally coupled to the head of the lacrosse stick by suitable binding materials. The "Mesh" configuration does, however, still employ the transverse lacing which reinforces the end of the web adjacent the end wall of the frame, to reinforce that portion of the web.

While the "Mesh" lacrosse stick head advantageously defines a ball pocket which readily expands to provide a conforming configuration for receiving a ball and thus facilitates ball handling, the "Mesh" configuration lacks, in particular, sufficient structural rigidity to ensure long life in the face of catching and throwing balls traveling at high velocity. Furthermore, the resiliency of the mesh can hinder the transfer of thrust from the player to the ball while throwing and, because of its widthwise uniformity, can decrease throwing accuracy, as described more fully below.

Yet another string configuration known in the art is called the "Meditional". That configuration includes a central mesh portion and open weave lacing interconnecting the mesh portion to the side walls of the frame. Transverse lacing is again provided to reinforce the end of the ball pocket adjacent the end wall of the frame.

That configuration provides sufficient flexibility centrally of the head to facilitate the formation of a ball pocket of proper configuration while limiting expansion of the mesh on ball receipt and ball throwing due to the relatively nondeformable open weave lacings. However, the "Meditional" configuration, like the "Mesh" lacks sufficient structural rigidity to facilitate imparting thrust to a ball during throwing, to limiting expansion of the mesh on receipt, and a configuration which guides the ball into and out of the pocket when receiving or throwing.

Yet a further problem common to each of the above-identified prior art string configurations is that, with use, the string can become distorted so that the ball pocket becomes too big. Because the transverse lacing is strung for the original ball pocket size, once the pocket has become larger, the transverse lacing is no longer proper for the pocket. As a result, when the ball leaves the ball pocket on shooting, it bounces off the head upon first contact with the transverse lacing. Therefore, the player is unable to follow through with the stick and, thus, unable to control the trajectory of the ball. This premature, uncontrolled release of the ball is known as "whip". "Whip" presents particular problems to less experienced players who are unable to accommodate for "whip" by altering the manner in which they handle the lacrosse stick.

Thus, a string configuration has yet to be provided which enables the formation of a ball pocket which allows consistent and accurate catching, carrying and throwing of a ball while minimizing the energy a player has to use to impart sufficient thrust to a ball, minimizing the likelihood that damage to the string will spread, eliminating "whip", increasing throwing accuracy and increasing durability.

SUMMARY OF THE INVENTION

It is an object of the present invention to provide a string configuration for a lacrosse stick which combines the advantages of resiliency and limited damage propagation of a mesh material while retaining the deformation limiting, ball guiding, and thrust imparting characteristics of longitudinal thongs. It is a further object of the invention to provide a string configuration which eliminates "whip".

In accordance with the present invention, then, first and second longitudinal thongs are provided in spaced apart, substantially parallel relation along the central, longitudinal axis of the head of the lacrosse stick. Further, a mesh portion is provided between each of the longitudinal thongs and the corresponding side wall of the lacrosse stick head. The mesh portions are coupled to their respective longitudinal thongs and the longitudinal thongs are connected and maintained in predetermined spaced apart relation by, for example, an open weave lacing. The outer side edges of each of the mesh portions are coupled to the respective side walls of the lacrosse stick head with suitable binding material. Further structural rigidity and integrity is provided for the portion of the string adjacent the end wall of the lacrosse stick head with suitable transverse lacing which extends through and is coupled to the mesh portions, the open weave lacing, and the longitudinal thongs. Even further structural reinforcement is provided at the first and last ball enqaging portion of the head by a transverse thong element which secures the uppermost end portion of the mesh to the end wall of the lacrosse stick head and is engaged by and extends across a portion of the lacrosse stick head with the transverse lacing.

Thus, the mesh portions defined between the longitudinal thongs and the sidewalls of the lacrosse stick head provide a degree of resiliency so that the ball pocket conforms substantially to the shape of the ball when disposed therewithin while allowing easy release of the same. The resiliency of the mesh also facilitates catching and carrying the ball. The longitudinal thongs, however, limit the resiliency afforded by the mesh portions. As such, the longitudinal thongs provide a number of advantages. First, the substantially parallel thongs define a "track" for guiding a ball which contracts the webbing into the ball pocket portion. Likewise, on throwing, the longitudinal thongs guide the ball axially of the head, out of the pocket and to the upper portion of the head where contact is terminated. In addition, the relatively non-resilient longitudinal thongs, together with the transverse lacing and transverse thong, facilitate transfer of thrust from the player to the ball when the ball is thrown. This minimizes the force which the player must use to throw the ball and ensures reliable release of the ball from the lacrosse head web so that, together with the guidance provided by the longitudinal thongs, throwing accuracy can be increased. Even further, the strength of the longitudinal thongs increases the strength of the entire web configuration while, the mesh portions provide the additional advantage of minimizing the propagation of damage should a portion of the mesh be cut or otherwise worn to the point of fraying.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
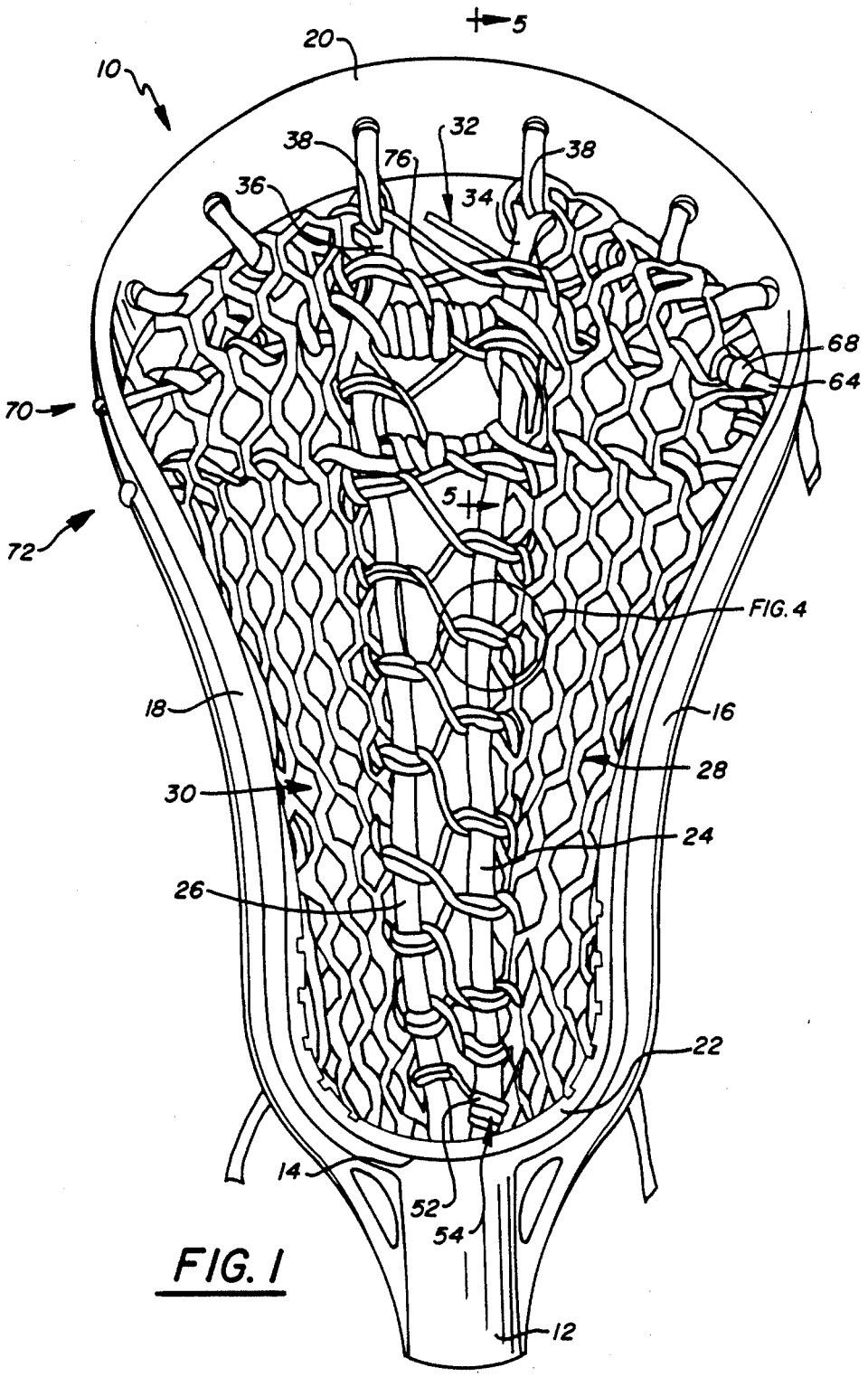
FIG. 1 is a front elevational view of a string lacrosse stick head provided in accordance with the present invention.
Figure 2:
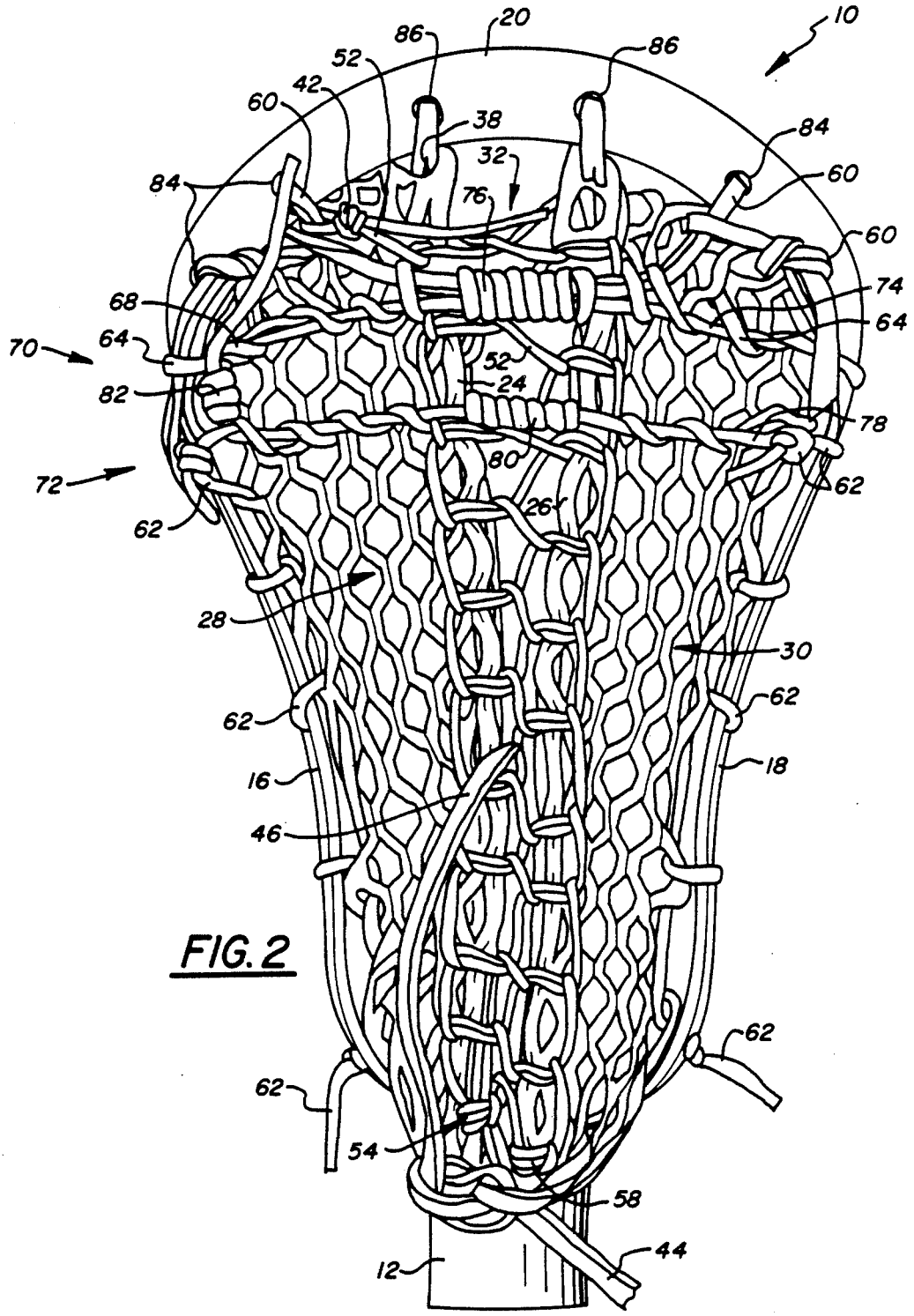
FIG. 2 is a rear elevational view of a string lacrosse stick head provided in accordance with the invention.
Figure 3:
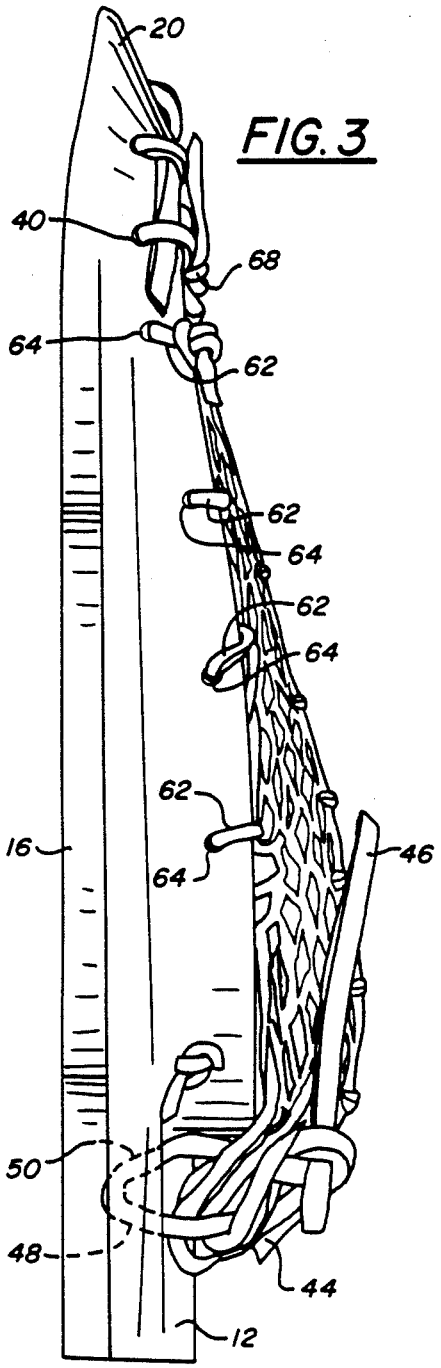
FIG. 3 is a side elevational view of a strung lacrosse head in accordance with the present invention.

The string lacrosse stick head 10 provided in accordance with the present invention can best be seen in FIGS. 1, 2 and 3. The lacrosse stick of the invention includes head 10 and a replaceable stick (not shown) which is engaged with a correspondingly sized and shaped axial bore defined in the base or throat 12 of the head 10. An aperture (not shown) is ordinarily defined through the sidewall of the base 12 of the head so that a screw can be threaded therethrough and into engagement with a stick received in the stick receiving bore, to secure the same to the lacrosse stick head.

In accordance with the illustrated embodiment, the head 10 is substantially inverted pear-shaped having an enlarged diameter portion adjacent the upper end thereof and a relatively narrow portion adjacent the stop 14, behind which a ball pocket is defined as discussed more fully below. Thus, two side walls 16, 18 extend upwardly from the base 12 and stop 14 and then diverge upwardly and outwardly to define the relatively wide upper portion of the lacrosse stick head.

As can further be seen, the side walls 16, 18 are defined in a plane which is substantially perpendicular to the plane of the lacrosse stick head. At the uppermost ends of the side walls, the frame structure is twisted so as to define an end wall 20 extending in a plane which is inclined slightly forwardly from the plane of the lacrosse stick head (see FIG. 5). Such a frame configuration is convention and facilitates the fielding of ground balls. The frame can be formed from any suitable rigid material such as, for example, a hard plastic.

A layer of relatively soft resilient material 22 is positioned inside the stop 14, as is also conventional. The resilient layer 22 provides markedly improved ball handling properties as is also well known.

Turning now to the string configuration of the invention, it can be seen that first and second longitudinal thongs 24, 26 are provided which extend substantially parallel to one another and parallel to the central axis of the head 10 along a substantial portion of the head. The thongs cross adjacent the throat 12, as described more fully below. Thus, the overall configuration of the thongs is an elongated, relatively narrow "V" as shown in FIG. 1. The thongs can be formed from any suitable inelastic, durable material such as, for example, leather. A mesh portion, in the illustrated embodiment, first and second mesh elements 28, 30 are mounted to the head 10 and to the longitudinal thongs 24, 26 so as to extend across the gap defined between the longitudinal thongs and respective side walls 16, 18 of the head. The mesh is formed, for example, from a knitted, high strength, synthetic material, such as knitted nylon. A central lacing 32 is further provided and couples the mesh portions 28, 30 to the longitudinal thongs 24, 26 and the longitudinal thongs 24, 26 to one another, as described in detail below with reference to FIG. 4.

Figure 5:
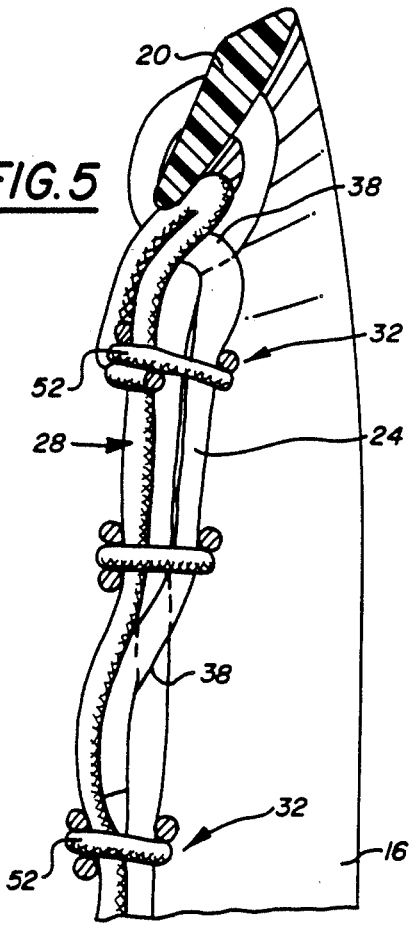
FIG. 5 is an enlarged view showing the connection of a mesh portion to the frame with a longitudinal thong in accordance with the invention, taken along line 5—5 of FIG. 1 with the transverse lacing omitted for clarity.

Referring in particular to FIGS. 2 and 5, it can be seen that the mesh portions 28, 30 of the invention have a length which is greater than the length of the opening defined by the frame of the head of the lacrosse stick. Thus, the upper ends of the mesh portions 28, 30, which are mounted to the end wall 20 of the frame, are folded back upon themselves to enable both positive attachment of the mesh portions 28, 30 to the frame and reinforcement of the upper end of the lacrosse stick web (FIG. 5). The lowermost ends of the mesh portions 28, 30, on the other hand, are secured to the base or throat 12 of the frame, as discussed more fully below.

As shown in FIGS. 1, 2 and 5, the longitudinal thongs 24, 26 include first ends 34, 36 adapted to be coupled to the end wall 20 of the frame. First and second slits 38 are provided in the first ends of each thong. Thus, when the lacrosse head is to be strung, the first ends 34, 36 of the longitudinal thongs 24, 26 are thread through apertures defined in the end wall of the lacrosse stick from the front of the frame to the back, into the frame as shown in FIG. 1. The first end of each longitudinal thong is then fed through aligned mesh openings of the folded over mesh and through the first and second slits 38 of the respective thong so as to anchor the longitudinal thong to the end wall 20 as well as to mount the upper end of each mesh portions 28, 30 to the lacrosse stick frame (FIG. 5). The central lacing 32 is then threaded through the mesh portions 28, 30 and around the respective longitudinal thongs and between the longitudinal thongs themselves so as to secure the inner edges of the mesh portions to the longitudinal thongs and so as to define a predetermined spaced part configuration of the longitudinal thongs, as discussed more fully below.

The second ends 44, 46 of the longitudinal thongs 24, 26 cross one another adjacent throat 12 and are passed through the openings in the mesh portions adjacent their bottom end so as to secure the mesh portions 28, 30 to the throat 12. The second ends 44, 46 are then inserted into first apertures 48 defined on the sides of the throat 12 of the lacrosse stick head (FIG. 3). The second ends 44, 46 of the thongs 24, 26 are then inserted through second apertures 50 and again threaded through openings adjacent the bottoms of the mesh portions. Finally, the second ends are knotted at the rear edge of the stop 14 (FIG. 2). As is apparent, because each of the mesh portions have a substantially constant width, the relatively constricted mounting of the mesh elements adjacent the throat of the head defines a ball pocket behind the stop as shown in particular in FIGS. 2 and 3.

Figure 4:
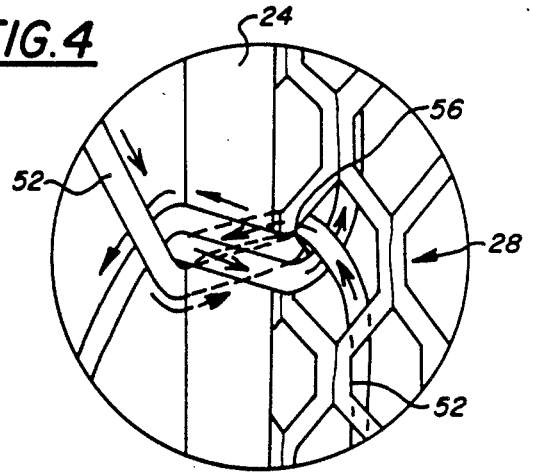
FIG. 4 is an enlarged view of a portion of the string configuration of FIG. 1, showing the connection of a mesh portion to a longitudinal thong along the length of the thong.

Before or after the longitudinal thongs 24, 26 have been fastened to the throat 12, central lacing 32 can be used to interconnect the mesh to the longitudinal thongs and to interconnect the longitudinal thongs with one another. One manner in which the central lacing 32 may be effected is as follows. A strand of lacing material such as a nylon rope 52 is secured at a first end thereof so as to encircle a portion of the mesh and one of the longitudinal thongs as shown generally at 54 in FIG. 2. The rope is then inserted through a mesh opening of the mesh element 28 moved about the respective thong 24, looped under itself and up towards a next mesh opening (FIG. 4). This looping of the mesh about the thong and under itself is continued up the longitudinal thong 24 to the uppermost end of the mesh 28. At that point the rope 52 is threaded across the gap between the longitudinal thongs 24, 26 and about the mesh element 30 and thong 26 on the opposite side and again across the gap between the longitudinal thongs 24, 26. The rope is then inserted through the loop 56 defined between the mesh 28 and the first longitudinal thong 24 during the first portion of the stringing process and is fed back to the second longitudinal thong 26. This threading process is repeated in a criss-cross fashion interlocking the rope 52 with the first, vertical, looped portion of the central lacing 32. At the base of the second longitudinal thong 26, the rope or lace 52 can be looped several times about the thong 26 and the mesh material 30 to knot the central lacing 32 at the base of the second thong 26 as shown at 58 in FIG. 2. The rope 52 is then thread upwardly and looped about the mesh element 30 and the second longitudinal thong 26 in a manner analogous to the looping between the first mesh element 28 and longitudinal thong 24, while interlocking with the criss-cross lacing between the thongs in a manner analogous to the knotting along the first thong 24, described with reference to FIG. 4. At the uppermost end of the second longitudinal thong 26 the central lacing 32 is knotted as at 42, for example, to a transverse thong 60 (FIG. 2).

Of course, other central lacing configurations could be provided and/or a mesh material could be provided between the longitudinal thongs. However, central lacing substantially as described above is preferred to ensure positive coupling of the longitudinal thongs to the mesh portions as well as to couple the longitudinal thongs in a predetermined spaced relation.

Before or after the central lacing 42 has been applied to the longitudinal thongs 24, 26 and mesh portions 28, 30, the outer edges of each of the mesh portions 28, 30 are coupled to the head frame with, for example, a binding rope or string 62. In the illustrated embodiment, the binding 62 is looped through apertures 64 defined through the side frames 16, 18 and through loops in the mesh in a manner similar to the initial interlocking of the first longitudinal thong 24 and first mesh element 28 with rope 52.

Once the mesh element has been coupled to the frame by the binding 62, first and second transverse lacings 70, 72 are applied to the string configuration as follows. A lace or rope 64 is coupled, for example, to an aperture defined in the frame by inserting one end of the rope 64 through an opening in the second mesh element 30 and through an aperture 40 in the frame and securing the same with a barrel knot 68. The rope 64 is then drawn directly across the mesh element 30 and longitudinal thongs 26, 24 and is looped through the first mesh element 28 adjacent to the side frame 16 thereof and looped through an aperture defined in the frame itself. The transverse lacing is then threaded back across the webbing by looping the same through successively diagonally offset apertures of the mesh and around the first, straight portion 74 of the transverse lacing. A transverse thong 60 is provided so as to be disposed in parallel to a central portion of the straight portion 74. Thus, as the rope 64 is being spirally wound back across the head 10, the transverse thong 60 is engaged and bound to the straight portion 74. Preferably a number of successive spiral loops 76 of transverse lacing are applied at the mid portion of the head between the longitudinal thongs 24, 26 so as to reinforce this portion of the web and to maintain the longitudinal thongs in predetermined spaced apart relation. The central lacing 32 is coupled to the transverse lacing 70 as well as at this point. The spiral winding is continued to the first edge 16 of the frame and is extended through the loop of the first end of the rope 64 to the frame.

The rope 64 is then looped through a loop defined at the end of the side binding 62 and is fed across the mesh portions 28, 30 and longitudinal thongs 24, 26 and ultimately through the side binding 62 on the opposite side of the frame. The rope 64 is then spirally wound in a manner similar to the first transverse lacing portion 70 so as to engage diagonally offset apertures of the mesh element and the second, straight portion 78. Again, between the longitudinal thongs 24, 26, a series of spiral windings 80 are provided so as to reinforce that portion of the lacrosse stick head web. During spiral winding 76, 80 of the rope 64, the central lacing 32 is engaged to form an integral string configuration. The terminal end of the transverse lacing 72 is ultimately bound to the first portion 70 of the transverse lacing as at 82. In this regard, it is noteworthy that the transverse lacings 70, 72 can be independently wound rather than being formed from a single continuous piece of lacing material 64. Likewise, other lacing patterns can be employed provided that a transverse reinforcement of the mesh portions and longitudinal thongs is provided by the transverse lacings 70, 72.

Each longitudinal end of the transverse thong 60 is thread through apertures 84 defined on either side of the apertures 86 receiving the longitudinal thongs 24, 26. The transverse 60 thong is knotted to the sidemost aperture as shown for example in FIG. 2. The longitudinal thong may be coupled to the frame before or after the transverse lacing is applied or as an intermediate step during the transverse lacing process. As a further alternative, one end of the transverse thong may be coupled prior to lacing and the opposite end thereof coupled following transverse lacing.

As is apparent from the string configuration illustrated in the drawings and described above, the first and second longitudinal thongs limit the deformation allowed by the mesh portions of the lacrosse stick which allowing a secure pocket to be formed for the ball. Furthermore, a structurally reinforced portion is defined adjacent the end wall of the frame to enhance the durability of the webbing as well as facilitate the impartation of thrust to the lacrosse ball and consistent ball release. Even further, the longitudinal thongs define a positive channel into the ball pocket so as to define a path for the ball into and out of the pocket during catching and throwing.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

Thus, it is to be understood that variations in the particular threading sequence, configuration and materials employed as well as head from shape and configuration can be made without departing from the novel aspects of this invention as defined in the claims.

What is claimed is:

1. A head for a lacrosse stick comprising:

a frame member having first and second side walls, each of said side walls having a proximal end and a distal end, an end wall extending between said distal ends of said side walls, and a transverse stop element extending between said side walls adjacent said proximal ends thereof; and a web of string-like material coupled to said frame, said web including:

first, and second longitudinal thong elements and a mesh portion, said mesh portion being coupled to each of said longitudinal thong elements and extending at least between each said thong element and a respective side wall of said frame, means for coupling said mesh portion to each said side wall, means for coupling one longitudinal end portion of said mesh portion to said end wall of said frame, and means for coupling the other longitudinal end portion of said mesh portion to said frame adjacent said proximal ends of said side walls.

2. A lacrosse stick head as in claim 1, wherein said mesh portion includes first and second mesh elements, a said mesh element being coupled to each respective longitudinal thong element and extending between said respective thong element and a respective side wall of said frame.

3. A lacrosse stick head as in claim 1, wherein said means for coupling said mesh portion to each said longitudinal thong element comprises a central lacing element.

4. A lacrosse stick head as in claim 3, wherein said central lacing element extends between said longitudinal thong elements so as to secure said longitudinal thong elements to one another in a predetermined spaced relation.

5. A lacrosse stick head as in claim 1, wherein each said longitudinal thong element is coupled to a corresponding aperture defined in said end wall.

6. A lacrosse stick head as in claim 5, wherein a distal end of each said longitudinal thong element has at least one slit defined therein for threadingly receiving the remainder of the respective longitudinal thong, whereby the longitudinal thong is secured to said end wall by looping the same through said respective aperture and inserting a proximal end of said longitudinal thong through said respective slit.

7. A lacrosse stick head as in claim 1, wherein said means for coupling said mesh portion to said side walls comprise at least one binding element looped through longitudinally spaced loops of said mesh portion and through correspondingly disposed apertures in each said side wall.

8. A lacrosse stick head as in claim 1, further comprising at least one transverse lacing element.

9. A lacrosse stick head as in claim 8, wherein said transverse lacing element includes a first substantially linear transverse portion and a second portion spirally wound about said linear portion so as to couple the same to said mesh portion.

10. A lacrosse stick head as in claim 9, wherein said transverse lacing element includes a tightly wound spiral portion between said longitudinal thong elements.

11. A lacrosse stick head as in claim 8, wherein first and second transverse lacing elements are provided.

12. A lacrosse stick head as in claim 10, wherein said means for coupling said mesh portion to said end wall comprises a transverse thong element looped through apertures defined in an upper end portion of said mesh portion and through corresponding apertures in said end wall.

13. A lacrosse stick head as in claim 12, wherein said transverse thong element is bound to said transverse lacing element by looping said spiral portion of said transverse lacing around both a portion of said transverse thong and said linear transverse lacing portion.

14. A lacrosse stick head as in claim 1, wherein said means for coupling said mesh portion to said end wall comprises said longitudinal thong elements.

15. A lacrosse stick head as in claim 14, wherein a distal end of each said longitudinal thong element has at least one slit defined therein for threadingly receiving the remainder of the respective longitudinal thong, whereby the longitudinal thong is secured to said end wall by looping the same through said respective aperture, said on end of said mesh portion, and inserting a proximal end of said longitudinal thong through said slit.

16. A lacrosse stick head as in claim 14, wherein said means for coupling said mesh portion to said end wall further comprises a transverse thong element looped through apertures defined in an upper end portion of said mesh portion and through corresponding apertures in said end wall.

17. A lacrosse stick head as in claim 15, wherein said means for coupling said mesh portion to said end wall further comprises a transverse thong element looped through apertures defined in an upper end portion of said mesh portion and through corresponding apertures in said end wall.

18. A lacrosse stick head as in claim 17, wherein said mesh portion is folded back upon itself prior to engagement with said longitudinal thong and said transverse thong element.

19. A lacrosse stick head as in claim 1, wherein said means for coupling said proximal end of said mesh portion to said frame comprises threading proximal ends of said longitudinal thong elements through the mesh portion adjacent said stop and securing said longitudinal thongs to said frame adjacent said stop.

20. A lacrosse stick head as in claim 19, wherein said longitudinal thong elements are secured to said frame at said proximal ends thereof by looping said longitudinal thongs through first and second apertures respectively defined on each side of said frame and tying said longitudinal thongs together.

* * * * *